US009518454B2

(12) United States Patent
Current et al.

(10) Patent No.: US 9,518,454 B2
(45) Date of Patent: Dec. 13, 2016

(54) METHODS AND SYSTEMS FOR CONTROLLING NETWORKED ELECTRONIC SWITCHES FOR REMOTE DETONATION OF EXPLOSIVE DEVICES

(71) Applicant: Pacific Scientific Energetic Materials Company (California) LLC, Valencia, CA (US)

(72) Inventors: Peter J. Current, Castaic, CA (US); Michael R. Hathaway, Valencia, CA (US); Steven D. Nelson, Huntington Beach, CA (US); Richard A. Davis, San Jose, CA (US); Joshua A. Curtis, San Jose, CA (US); Joe E. Carvalho, Hollister, CA (US); Ruben G. Aguila, San Jose, CA (US)

(73) Assignee: Pacific Scientific Energetic Materials Company (California) LLC, Valencia, CA (US)

( * ) Notice: Subject to any disclaimer, the term of this patent is extended or adjusted under 35 U.S.C. 154(b) by 135 days.

(21) Appl. No.: 14/318,537

(22) Filed: Jun. 27, 2014

(65) Prior Publication Data

US 2015/0000509 A1 Jan. 1, 2015

Related U.S. Application Data

(60) Provisional application No. 61/840,457, filed on Jun. 27, 2013.

(51) Int. Cl.
*E21B 43/1185* (2006.01)
*E21B 43/11* (2006.01)
*E21B 43/116* (2006.01)

(52) U.S. Cl.
CPC ..... *E21B 43/11857* (2013.01); *E21B 43/11* (2013.01); *E21B 43/116* (2013.01)

(58) Field of Classification Search
CPC ..... E21B 43/11; E21B 43/116; E21B 43/1185; E21B 43/11857; E21B 47/12; E21B 7/00; F42D 1/05; H01R 13/637
See application file for complete search history.

(56) References Cited

U.S. PATENT DOCUMENTS

2007/0234921 A1* 10/2007 Han ..... E21B 36/003 102/331
2009/0272529 A1* 11/2009 Crawford ..... E21B 47/10 166/250.15

(Continued)

OTHER PUBLICATIONS

International Application No. PCT/US2014/044752, International Search Report & Written Opinion, 9 pages, Mar. 10, 2015.

*Primary Examiner* — Yong-Suk (Philip) Ro
(74) *Attorney, Agent, or Firm* — Perkins Coie LLP

(57) ABSTRACT

A method and system are disclosed for controlling a plurality of perforating gun assemblies arranged in a gun train and lowered into a wellbore. The perforating gun assemblies are connected to a top sub controller that is also lowered into the wellbore. The top sub controller includes a first communications module to communicate with an above-ground control panel via a wireline and a second communications module to communicate with a switch sub in each the plurality of perforating gun assemblies via a network bus. Each switch sub has a unique network address. During assembly, the control panel automatically detects the order of the perforating gun assemblies in the gun train based on polling each of the switch subs of the plurality of perforating gun assemblies using the respective unique network addresses.

20 Claims, 11 Drawing Sheets

(56) References Cited

U.S. PATENT DOCUMENTS

2011/0090091 A1* 4/2011 Lerche ..... E21B 41/0021
340/853.2
2013/0133889 A1* 5/2013 Schacherer ..... E21B 29/02
166/297

* cited by examiner

METHODS AND SYSTEMS FOR CONTROLLING NETWORKED ELECTRONIC SWITCHES FOR REMOTE DETONATION OF EXPLOSIVE DEVICES

CROSS-REFERENCE TO RELATED APPLICATION

The present application claims priority to and benefit from U.S. Provisional Patent Application No. 61/840,457 titled "Methods And Systems For Controlling Networked Electronic Switches For Remote Detonation Of Explosive Devices" filed on Jun. 27, 2013, the entire content of which is herein expressly incorporated by reference.

FIELD

The following disclosure generally relates to methods and systems for setting a plurality of explosive devices located remotely down-hole beneath the earth's surface using a networked switching system, and controlling the detonation of the plurality of explosive devices using network addresses corresponding to the explosive devices.

BACKGROUND

Hydraulic fracturing, also known as "fracking," is a process for drilling beneath the earth's surface to extract natural gas from shale rock. Once the rock formation is reached, a combination of water, sand and chemicals are inserted into the well to fracture the rock and release gas.

The first step for fracking is to drill and case a well A hole is drilled down vertically and then surface casing is inserted into the hole. Cement is pumped through the casing to seal off the wellbore from fresh water in the earth. After further vertical drilling is completed, a down hole drilling motor is inserted to begin horizontal drilling. When a target distance is reached, production casing is inserted into the full length of the wellbore, and cement is pumped down the casing and out through the hole. Once this step is completed, the hole has been dug and the casing prevents hydrocarbons from seeping out as they are brought to the surface.

The next step is to "perf and frack" the area. "Perfing" is accomplished via a "perforating gun," which is lowered into the casing. Typically, a plurality of perforating guns, along with corresponding switch subs, are connected to form a gun train. The switch subs include an electronic switch that sends a signal to detonate the corresponding gun. The perf gun is loaded with extremely high explosives. The gun train is lowered by a wireline into the casing, and an electrical current is sent down the hole to set off the explosives in the perf gun. The explosives shoot small holes into the casing and cement. The perf gun explosives can develop a blast pressure on the order of 10 million PSI. The extreme pressures are necessary to overcome both the hydrostatic pressure and the yield pressure of the steel pipe of the perf gun.

After the explosions, the gun train is then pulled from the well. The small holes created by the perf guns provide perforations for the "fracking" stage, which occurs after the gun train is removed.

Finally, the well is "fracked" by sending water, sand and lube into the wellbore under high pressure. The holes in the walls of the well that were blown by the perf gun create channels for this "fracking fluid" to reach the surrounding shale. The extreme pressure causes the shale to fracture, creating a path that allows released gas to flow to the wellbore. Once fracking is complete, a permanent wellhead is installed and a pipeline is constructed to transport the gas.

SUMMARY OF THE DISCLOSURE

Exemplary embodiments of the disclosure are directed to a method and system for defining addresses for a networked switching system, controlling and enabling user control over the detonation of a plurality of explosive devices, and setting a plurality of charges located remotely down-hole beneath the earth's surface.

For example, an exemplary embodiment of the disclosure is directed to an addressable switch system that includes a plurality of perforating gun assemblies that are lowered into a wellbore. Each of the plurality of perforating gun assemblies includes a switch sub comprising a network communications module with a unique network address for communications over a network bus, and a perforating gun comprising explosives. The addressable switch system also includes a control panel for at least one of monitoring and controlling the plurality of perforating gun assemblies and a top sub controller that is also lowered into the wellbore. The top sub controller has a first communications module to communicate with the control panel via a wireline and a second communications module to communicate with the plurality of perforating gun assemblies via the network bus. The control panel includes an interface to select one perforating gun assembly from the plurality of perforating gun assemblies based on the unique network address of the switch sub corresponding to the selected perforating gun assembly. The control panel interface can also provide a command signal that at least one of arms and fires the perforating gun corresponding to selected perforating gun assembly.

Another exemplary embodiment is directed to a method for operating an addressable switch system. The method includes providing a plurality of perforating gun assemblies, with each of the plurality of perforating gun assemblies comprising a switch sub and a perforating gun. The method further includes providing a top sub controller and a unique network address for communications over a network bus to each of the switch subs in the plurality of perforating gun assemblies. The method further includes installing explosives in each of the perforating guns of the plurality of perforating gun assemblies and monitoring and controlling the plurality of perforating gun assemblies using a control panel. The method also includes communicating between the control panel and the top sub controller via a wireline and communicating between the top sub controller and the plurality of perforating gun assemblies via the network bus. The method further includes selecting one perforating gun assembly from the plurality of perforating gun assemblies based on the unique network address of the switch sub corresponding to the selected perforating gun assembly, and providing a command signal that at least one of arms and fires the perforating gun corresponding to selected perforating gun assembly.

BRIEF DESCRIPTION OF DRAWINGS

These and other objects, features and characteristics of the present invention will become more apparent to those skilled in the art from a study of the following detailed description in conjunction with the appended drawings, all of which form a part of this specification. In the drawings.

DETAILED DESCRIPTION

In conventional systems and assemblies for down-hole blasting, such as fracking, the explosives in each "perf" gun are typically actuated by standard mechanical switches. For example, in known assemblies for fracking, mechanical switches select which perf gun in the gun train is being fired and then ultimately control its firing. While this often provides an acceptable solution, there can be problems with reliability. Typically, if a switch fails to activate a perf gun in the train, perhaps due to a short, there is no way for the operators working at ground level to then select other guns in that train for firing. This can result in a plugged well, requiring operators to pull out the malfunctioning equipment and waste valuable time and expense.

In accordance with certain embodiments of the disclosure, the conventional mechanical switching arrangement may be replaced with a networked architecture that enables digital communication between a controller that selects the perf gun to detonate and the switches that fire the charges in the perf gun. An electronic switch in the switch sub can include an application specific integrated circuit ("ASIC") configured to interpret and respond to certain digital signals, e.g., signals to arm and fire the perf gun associated with the switch sub. The ASIC can be associated with a unique address so as to be separately addressable for initiation by the controller. Furthermore, each of the ASICs in the switch subs can communicate over a networked bus configured for fault tolerant operation, such that, if a short causes a perf gun to malfunction, other perf guns in the train may still maintain communications over the bus.

Figure 1:
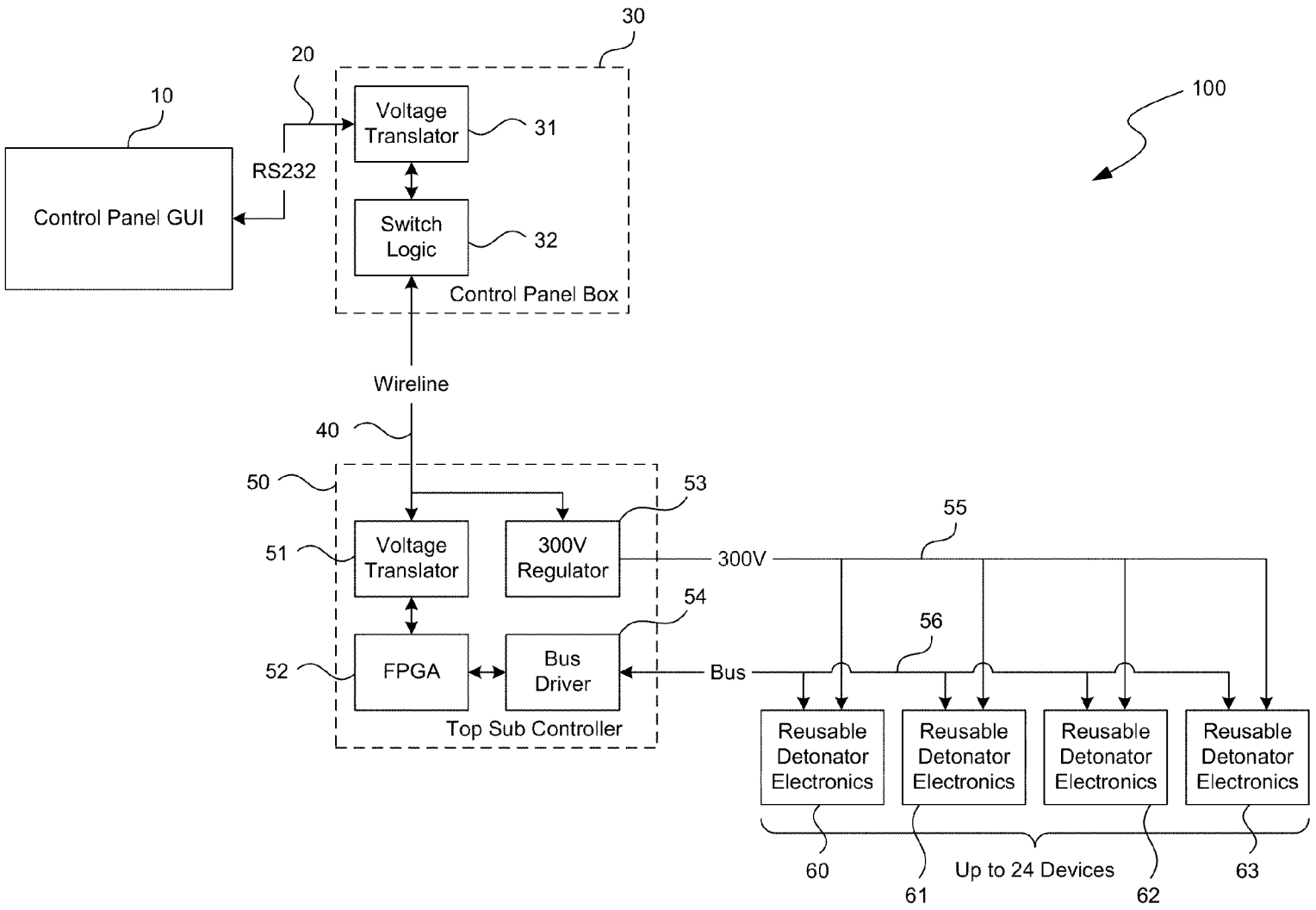
FIG. 1 is a block diagram of a networked switching system in accordance with an embodiment of the disclosure.

FIG. 1 is a block diagram for a network switching assembly 100 in accordance with an embodiment of the disclosure. The arrangement includes a control panel with a graphical user interface (GUI) 10, control panel box 30, top sub controller 50 and a set of reusable detonator electronics 60-63.

In an exemplary embodiment, the control panel 10 sends and receives signals via a serial communications protocol, such as an RS232 signaling link 20, to control panel box 30. The signals can be communicated to switch logic 32 via a voltage translator 31. Of course, other communications protocols may be utilized, and depending upon the protocol and the logic configuration, the voltage translator 31 may be unnecessary. In other embodiments, control panel with GUI 10 may be integrated into the control panel box 32, such that the RS232 link 20 may also be unnecessary. In addition, the control panel 10 (or a separate device) can perform logging and reporting functions that capture the time the perforating guns are fires, the depth, the shock data from accelerometers, etc. The reports can be sent to text or spreadsheet files or over a network to other computers.

In an exemplary embodiment, the control panel box 30 is above ground, at the top of the well. The control panel box 30 may be in communication with a top sub controller 50 via a wireline 40. The top sub controller 50 is in the well, and may be hundreds or even thousands of feet below the surface. In an exemplary embodiment, the wireline 40 includes a high voltage wire, which provides the high voltage, e.g., 300 volts, needed by the detonators in each perf gun. Wireline 40 is also capable of providing communications signals over a potentially long distance, e.g., from control panel box 30 to top sub controller 50. That is, both the communication signals and the high voltage is delivered to the top sub controller 50 using the same wire. In some embodiments, the high voltage is oscillated 8 to 12 volts, e.g., the 300 volt bus may oscillate from 288 volts to 312 volts, such that the top sub controller 50 "interprets" 288 volts as a digital "0" and 312 volts as a digital "1." Of course, other ranges such as, e.g., 270 volts to 300 volts can also be used.

In an exemplary embodiment, the wireline 40 is fed to voltage translator 51 in top sub controller 50. The voltage translator 51 converts the signal on wireline 40 to a low power signal to power and communicate with a field programmable gate array (FPGA) 52. The FPGA 52 is thus configured to bi-directionally communicate with switch logic 32. The signals communicated via switch logic 32 to FPGA 52 are then translated via Bus Driver 54 into signals that can be communicated over communication bus 56. Bus 56 is a low power communication line that, in some embodiments, can be up to approximately 40 m in length.

Bus 56 sends digital communication signals to the reusable detonator electronics 60-63 in each switch sub. In an exemplary embodiment, there may be up to 24 devices connected to the bus 56. The detonator electronics 60-63 can be individually addressed via switch logic 32 and signaled to, e.g., "ARM" or "FIRE." In some embodiments, the detonator electronics 60-63 can also receive signals to "DISARM." Upon receiving a "FIRE" signal, the detonator electronics switches 60-63 send power via the 300V power line 55 to their respective detonators, which then ignite the explosives in each perf gun. As shown in FIG. 1, in the exemplary embodiment, power line 55 is conditioned via a 300V regulator 53.

In an exemplary embodiment, each of the reusable detonator electronics 60-63 may be structurally the same. The electronics 60-63 may include an ASIC including a bus interface (see, e.g., 511, 512 in FIG. 5). The ASIC can include a logic device which signals an initiator (not shown) to ARM or FIRE. The ASIC also may be connected to an external capacitor (see 513 in FIG. 5), referred to as an energy fire capacitor, or ERC, for arming the initiator.

Figure 2:
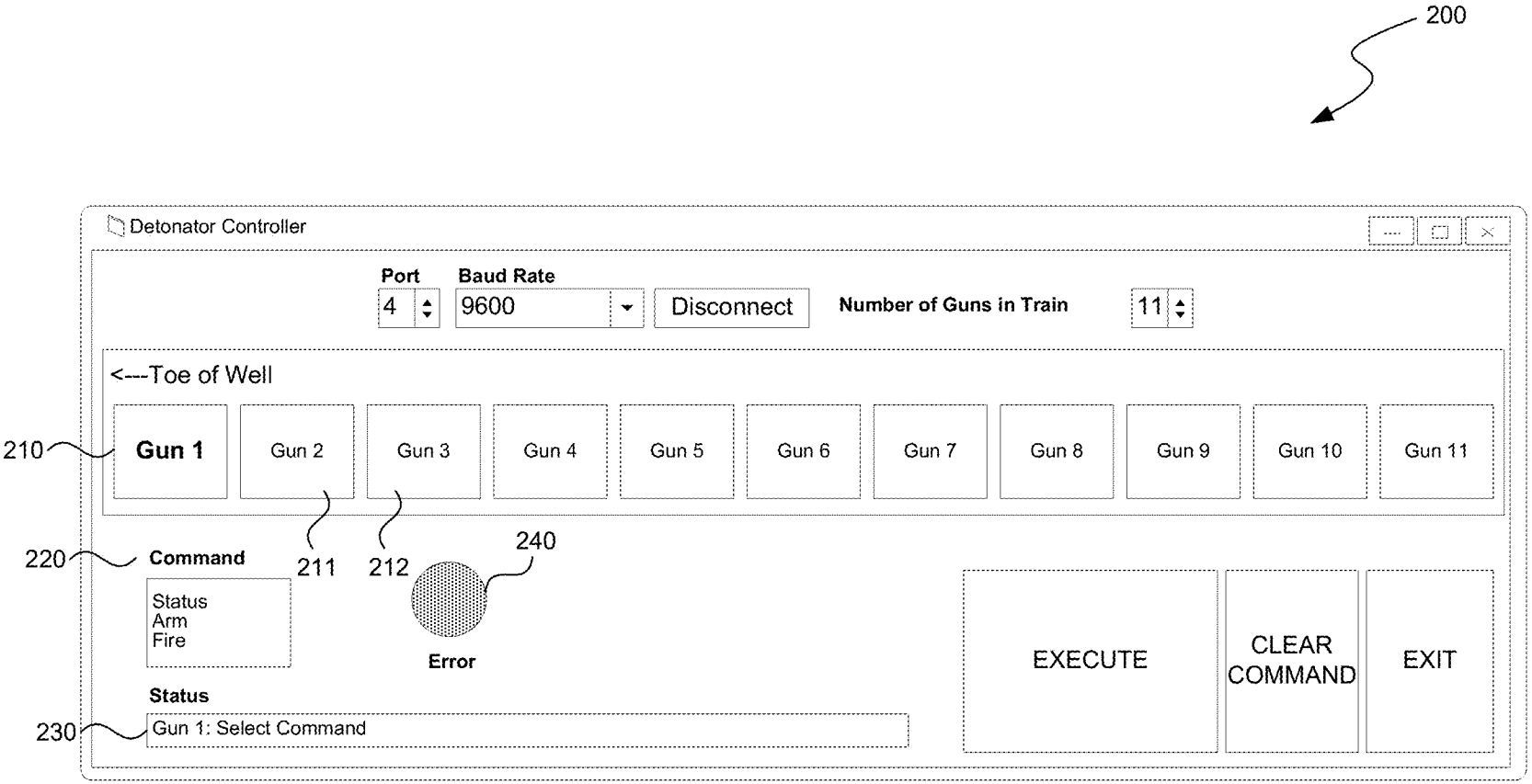
FIG. 2 provides an exemplary GUI for a control panel in a networked switching system in accordance with an embodiment of the disclosure.

FIG. 2 provides an exemplary graphical user interface (GUI) 200 for control panel 10. In a preferred embodiment, the exemplary GUI 200 can run on a laptop or on other portable electronic devices (such as a tablet). The GUI screen 200 may include soft keys or icons (e.g., 210, 211, 212) to individually select a perf gun in a perf gun train to control. For example, in the illustrated example, Gun 1 is selected as shown by the bolded border around icon 210. For each gun, a command box 220 can illustrate the options for user selection (e.g., STATUS, ARM, FIRE), and the command can be entered via a prompt at status bar 230. In some exemplary embodiments, a command to "DISARM" may also be entered. As an example, the status bar 230 in FIG. 2 prompts the user to select a command from the Command selections 220. Finally, GUI 200 may include an error indicator 240. The error indicator 240 can be configured so as to be specific to the selected perf gun (e.g., 210, 211, 212) or to indicate an error anywhere in the system, e.g., along the bus 56 (as a global indicator). The GUI 200 can also display information (not shown) from sensors located in the gun train. For example, each perf gun assembly can have a temperature sensor, a pressure sensor, and/or another measurement device to provide an indication of the conditions in the perf gun assembly and/or the wellbore. In addition, the top sub, which houses top sub controller 50, can also include sensors (such as temperature, pressure, etc.), and/or an accelerometer to provide indication of the conditions in the gun train and/or the wellbore. For example, accelerometer data from the top sub can be transmitted back to control panel 10 via communication bus 56, wireline 40, and the RS232 link 20 and then used to detect whether the explosives in a perf gun detonated or not. In some embodiments, in addition to the accelerometer in the top gun (or instead of the accelerometer in the top gun), each perf gun assembly can include an accelerometer.

In the exemplary embodiment, when the user selects a command for a perf gun (e.g., Gun 1—FIRE), the client computer running the GUI 200, e.g., control panel 10, sends a signal, via, e.g., an RS232 link 20, to control panel box 30, which in turn, will receive and interpret the signals from the control panel 10. For example, if Gun 1 is selected to fire, the control panel box 30 will interpret this command and determine the proper network address of the reusable electronics for Gun 1, and then send a signal with the Gun 1 fire command to top sub controller 50 via wireline 40 using the appropriate protocol. Top sub controller 50 receives and interprets the signal from control panel box 30 and relays the information, e.g., the command to file Gun 1, to the appropriate reusable electronics 60-63 corresponding to Gun 1 via communications bus 56. The reusable electronics 60-63 that corresponds to the selected Gun 1, receives and interprets the signal from bus 56. Because the signal from top sub controller 50 includes the network address of the reusable electronics for Gun 1, the reusable electronics 60-63 of the other perf guns "ignore" the signal from controller 50. Once the reusable electronics of Gun 1, which is already in an "armed" state, detects the fire signal based on the corresponding digital address, the reusable electronics of the Gun 1 will convert the status of Gun 1 from "ARMED" to "FIRE."

Figure 3:
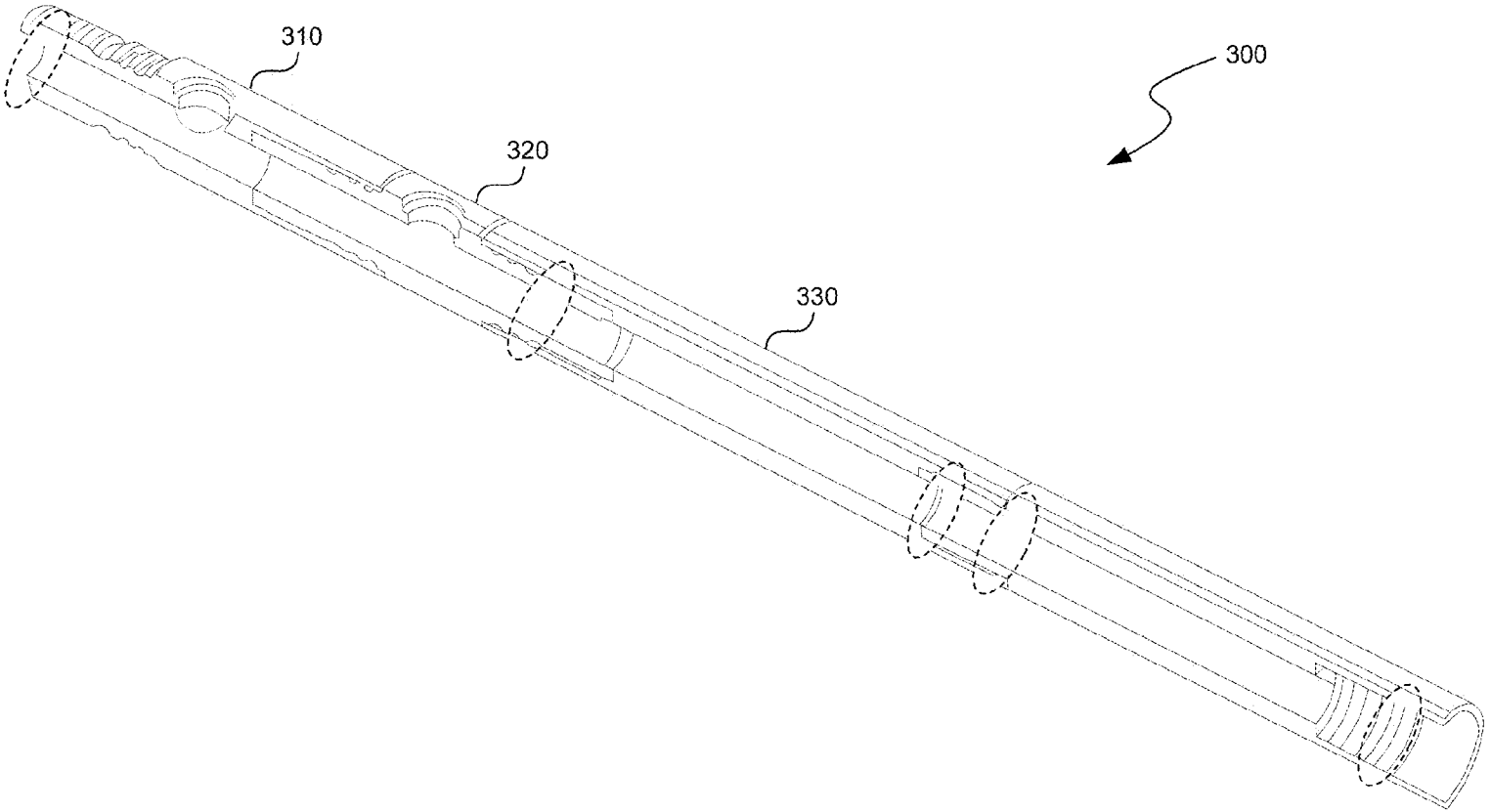
FIG. 3 illustrates a cross-sectional view of a portion of a housing for a perf gun assembly in a networked switching system in accordance with an embodiment of the disclosure.

In a fracking well, the casing in the horizontal section of the well can be quite narrow. Accordingly, the perf gun assembly is commonly configured as a narrow cylindrical tube that can be pushed and pulled along within the casing. FIG. 3 illustrates a cross-sectional view of a portion of the housing for a perf gun assembly. In this exemplary embodiment, the perf gun assembly 300 includes a switch sub 310, which contains the reusable detonator electronics 60-63 and, in some embodiments instrumentation such as, e.g. a temperature sensor, a pressure sensor, and/or other instrumentation, e.g., an accelerometer. The switch sub 310 is then connected, such as by a screwed (threaded) arrangement, to a tandem sub 320. In this example, the tandem sub 320 couples the switch sub 310 to the perf gun 330, which includes the explosives (not shown). The tandem sub 320 provides a finger hole to aid in the coupling of the gun assembly.

Figure 4:
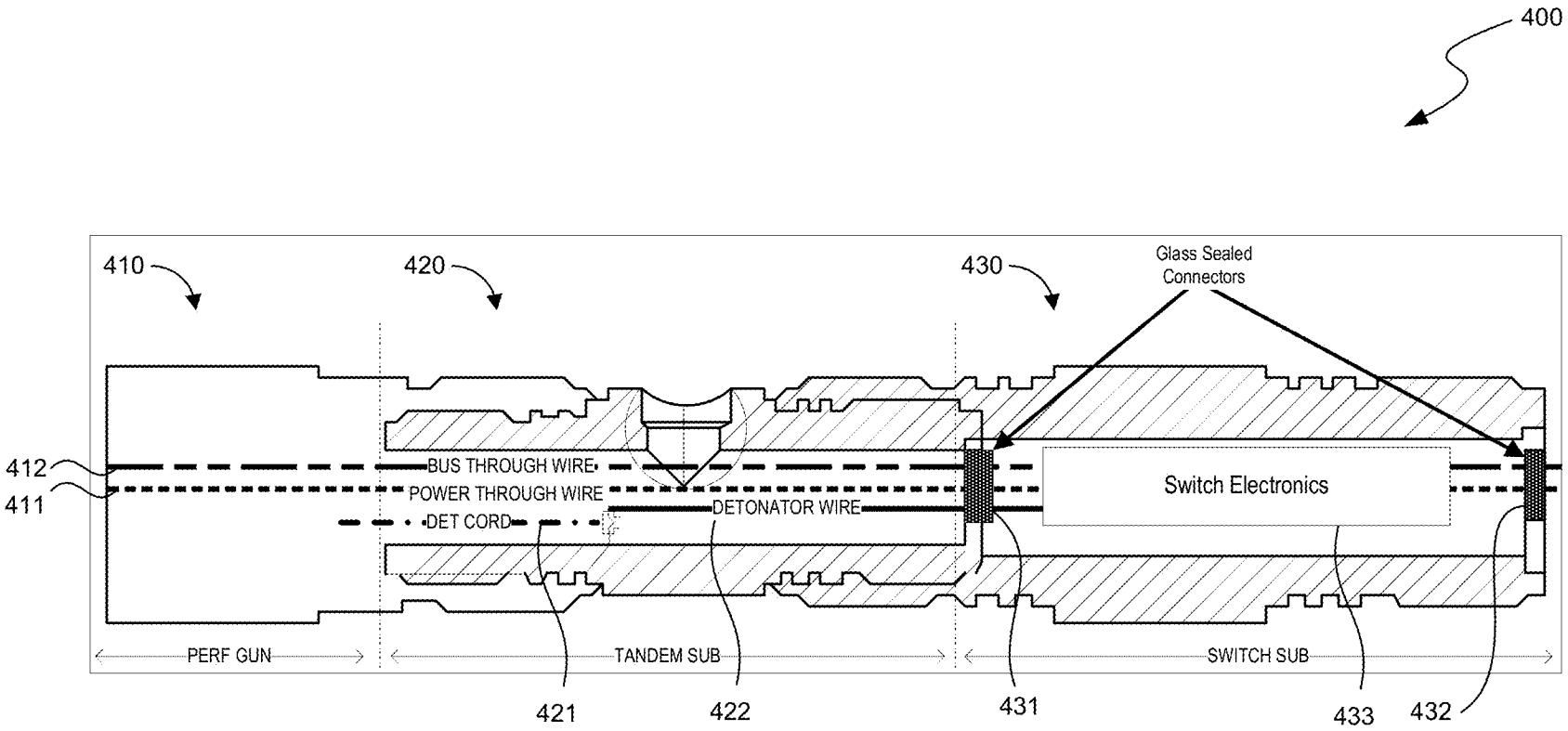
FIG. 4 illustrates a cross-section of a portion of a perf gun assembly in a networked switching system in accordance with an embodiment of the disclosure.

FIG. 4 illustrates a cross-section of a portion of a perf gun assembly. The perf gun assembly includes switch sub 430, tandem sub 420, and perf gun 410. In addition, as can be seen in FIG. 4, the perf gun assembly 400 includes a wire for the communications bus 412 (corresponding to bus 56 in FIG. 1), a high voltage power wire 411 (corresponding to the 300V wire 55 in FIG. 1), and a detonator wire 422. A detonator cord 421 is also provided. The detonator cord 421 is connected to the individual explosives (not shown) in the perf gun 410.

Figure 12:
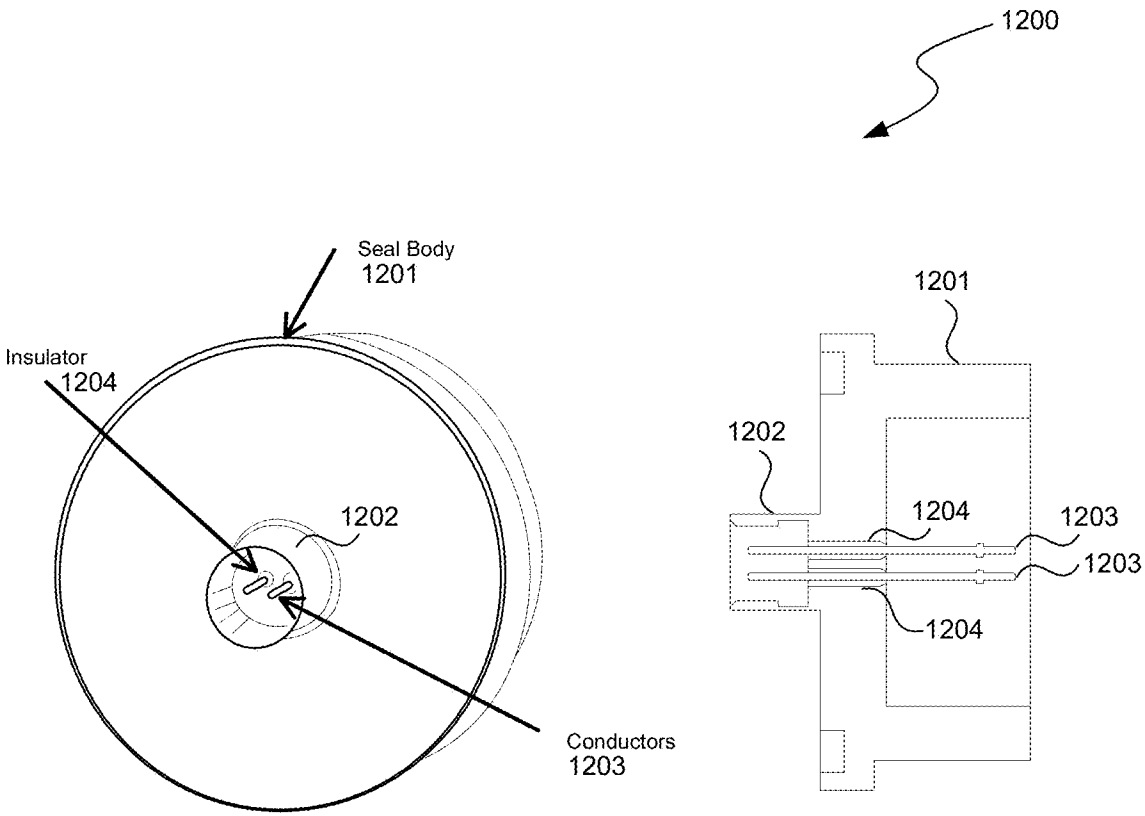
FIG. 12 illustrates an exemplary embodiment of a glass-to-metal seal assembly for use in a switch sub in a network switching system.

In the exemplary addressable switching system, switch sub 430 includes glass sealed connectors 431 and 432 at each end. These connectors are intended to protect the switch electronics 433 from heat, chemicals, gases, and other elements that are known to create a difficult environment for electronic components. In an exemplary embodiment, as seen in FIG. 12, a glass-to-metal seal assembly 1200 seals the internal electrical components (e.g., switch electronics 433, including the ASIC and reusable electronics 60-63 (see FIG. 1), and, in some embodiments, instrumentation such as accelerometers, temperature and pressure sensors, etc.) from high-pressure, high-temperature, and potentially toxic environments seen downhole. The glass-to-metal seal assembly 1200 includes a seal body 1201, a connector section 1202, conductors 1203, and insulators 1204. The conductors 1203 provide a conduction path to communicate an electrical signal in and out of the seal assembly 1200. The conductors 1203, which can be, e.g., high voltage bus 55 and communications bus 56, extend from the interior of a seal body 1201, through the seal body 1201 through glass insulating sleeves 1204 and out through the connector section 1202. The conductors 1203 are electrically insulated from the seal body 1201 by the glass insulators 1204. The number of conductors 1202 is not limited to two and can be one or three or more (dependent on design limitations such as space and structural stability of seal assembly 1200). The number of conductors 1202 will also depend on the application. For example, when the glass-to-metal seal assembly 1200 is used in the location of glass seal 432, the glass-to-metal seal assembly 1200 will include at least two conductors—bus 56 and bus 55, but when the glass-to-metal seal assembly 1200 is used in the location of glass seal 431, it will include three conductors—bus 55, bus 56, and detonation wire 422.

In some embodiments, the glass-metal assembly and/or the switch sub 430 can be filled or coated with a thermal management material to protect the electronics in the addressable system, e.g., the ASIC and reusable electronics 60-63, from high temperatures that could damage the electronics. The thermal management material has a sharp melting point and excellent heat resistance such that the thermal management material can be used around the electronics to increase the inherent thermal lag in the switch sub 430. This means that the switch sub 430 can be exposed to temperatures beyond the limits of the electronics for an extended length of time. This is because, when the thermal management material reaches it melting point, it takes a large amount of additional heat to increase the temperature in switch sub 430 beyond the melting temperature of the thermal management material. In some exemplary embodiments, the thermal management material is a polymer or wax, e.g., a polyethylene. An example of such a material is Polywax 3000 by Baker Hughes, Inc.

Figure 11:
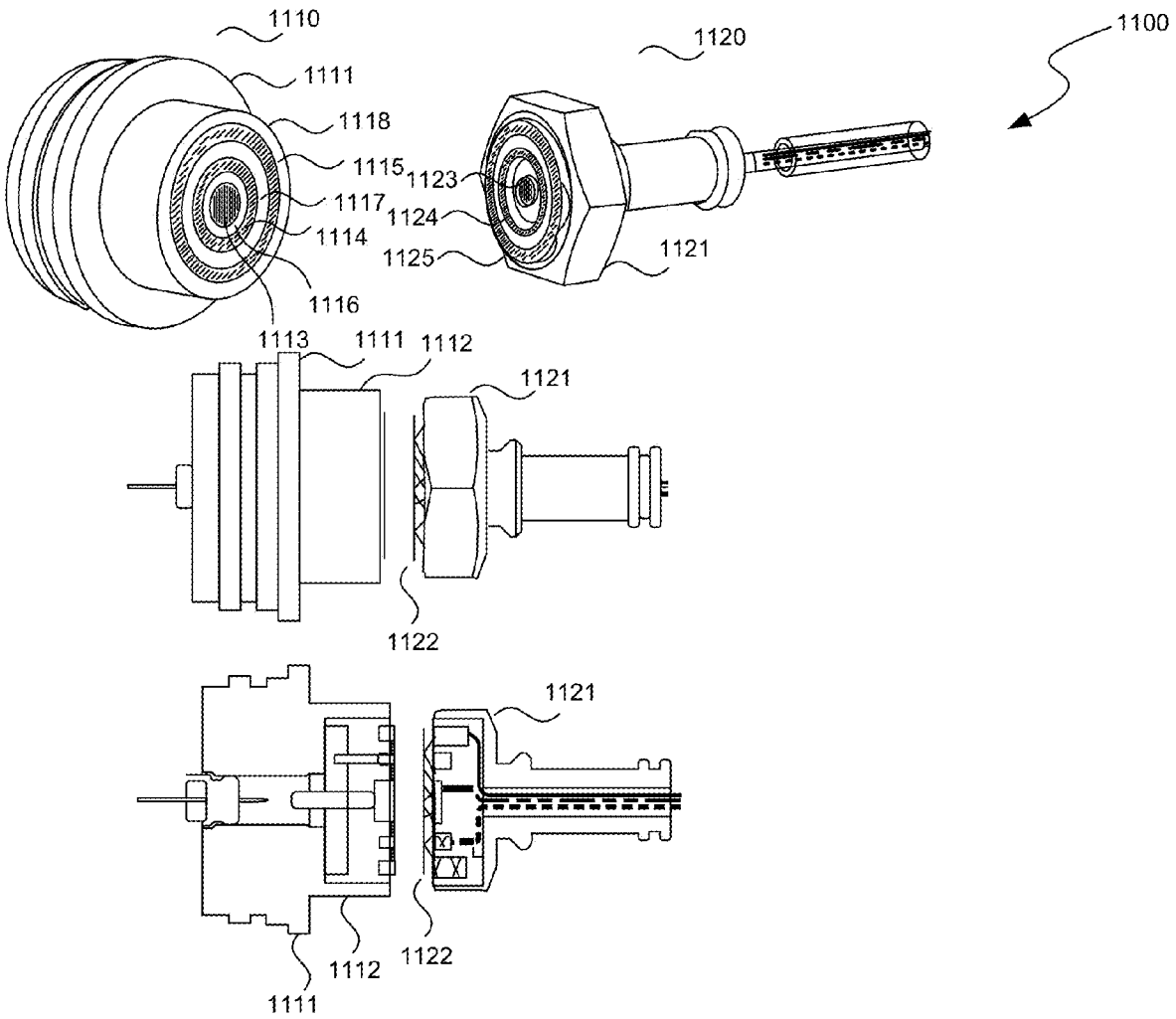
FIG. 11 illustrates an exemplary embodiment of a rotary connection assembly for use in the assembly process of a perforating gun assembly in a network switching system.

As discussed above, the various sections of the perf gun assembly (300, 400) are attached to each other by threaded connections. A threaded connection, however, makes it difficult to keep the communication bus wire 412 and the high voltage bus wire 411 from tangling as the various sections are twisted together. FIG. 11 illustrates a rotary connection assembly 1100 that allows the various sections to be twisted together without the wires being tangled. The rotary connection assembly 1100 includes a flush connector 1110 and spring-loaded connector 1120. The flush connector 1110 includes a metal casing 1111 with a connector section 1112. The connector section 1112 includes a center conductor 1113 and two concentric ring connectors 1114, 1115. The conductors 1113-1115 are housed in an insulating, heat resistant plastic, e.g., a Teflon plastic, such that the insulating material form concentric insulating sections 1116-1118 that are, e.g., flush with the conductors 1113-1115. The flush connector 1110 may include a glass-to-metal seal.

The spring-loaded connector 1120 includes a metal casing 1121 with a connector section 1122. The connector section 1122 includes a spring-loaded center conductor 1123 and two spring-loaded concentric ring conductors 1124, 1125. The flush connector 1110 is designed to mate with the spring-loaded connector 1120 such that the connectors 1113-1115 match up with and contact spring-loaded conductors 1123-1125, respectively. The contacts on the spring-loaded conductors 1123-1125, as the name implies have springs or other biasing mechanisms to ensure a positive contact with conductors 1113-1115. The spring-loaded connector 1120 may also have a glass-to-metal seal.

In some embodiments, the ends of each section in the perf gun assembly (i.e., perf gun 410, tandem sub 420, switch sub 430) will have either the flush connector 1110 or the spring-loaded connector 1120 and the corresponding end of the next section in the gun assembly will have the other mating connector 1110, 11120. By using a rotary design having a center conductor and concentric ring conductors, the sections of the perf gun assembly can be threaded together without twisting the wires. As with the metal-to-glass seal assembly 1200 discussed above, the number of conductors in the rotary connector assembly 1110 can vary depending on the application.

Continuing with FIG. 4, tandem sub 420 includes the bus wire 412, high voltage power wire 411 and detonator wire 422 that are each connected to switch electronics 433 in the switch sub 430. The bus wire 412 and the power wire 411 extend to the other perf guns via the glass-metal seal 1200 or rotary connector assembly 1100. When the switch electronics 433 indicates a firing condition, a signal is sent to the detonator wire 422 (with the housing of the tandem sub 420 acting as ground). The detonator wire 422 causes the explosives (not shown) in the perf gun 410 to detonate via the detonator cord 421.

In accordance with at least one embodiment, the ASIC in the reusable detonator electronics 60-63 can be preprogrammed with a network address that identifies the ASIC device to other devices on the bus 56, e.g., to sub controller 50, control panel box 30, control panel 10, etc. In some embodiments, the network addresses uniquely identifies each perf gun in the system. When a user builds a gun train, the addresses of each of the ASICs in the tandem subs 420 can be placed into the control system. Software that runs the control panel 10 can be configured to prompt the user via the GUI to enter each address into the control system, such that each perf gun assembly 400 is associated with a network address.

To ensure that the correct addresses are entered, in one embodiment, a tester (not shown) can be provided to confirm that, as the gun train is being assembled, the ASIC in each switch sub 420 is communicating properly and responding appropriately to its address. An "assembly checker" (not shown) can additionally include a USB port for a "memory stick" or some other storage device to store information concerning the order of each perf gun assembly 400 in a gun train, so that the information can then be transmitted to the control panel box 30, control panel 10, or another device as needed. In some embodiments, the information can be transmitted via a wired or wireless network.

In another embodiment, two ASICs can be provided in each switch sub 420. One ASIC controls the "firing" functions of the perf gun assembly 400 and the other ASIC controls a switch that either opens or closes the connection of the communications bus and the high voltage wire to the rest of the perf gun assemblies in the system. With this configuration, the switch logic 32 in the control panel box 30 can poll each of the perf gun assemblies 400 and turn them on/off one at a time to determine the order that they are in. In some embodiments, the poll function can be included in the control panel 10. In this manner, the addressing for the different switch subs 420 can be detected in an automated manner after the gun train is assembled, without requiring user intervention.

Figure 5:
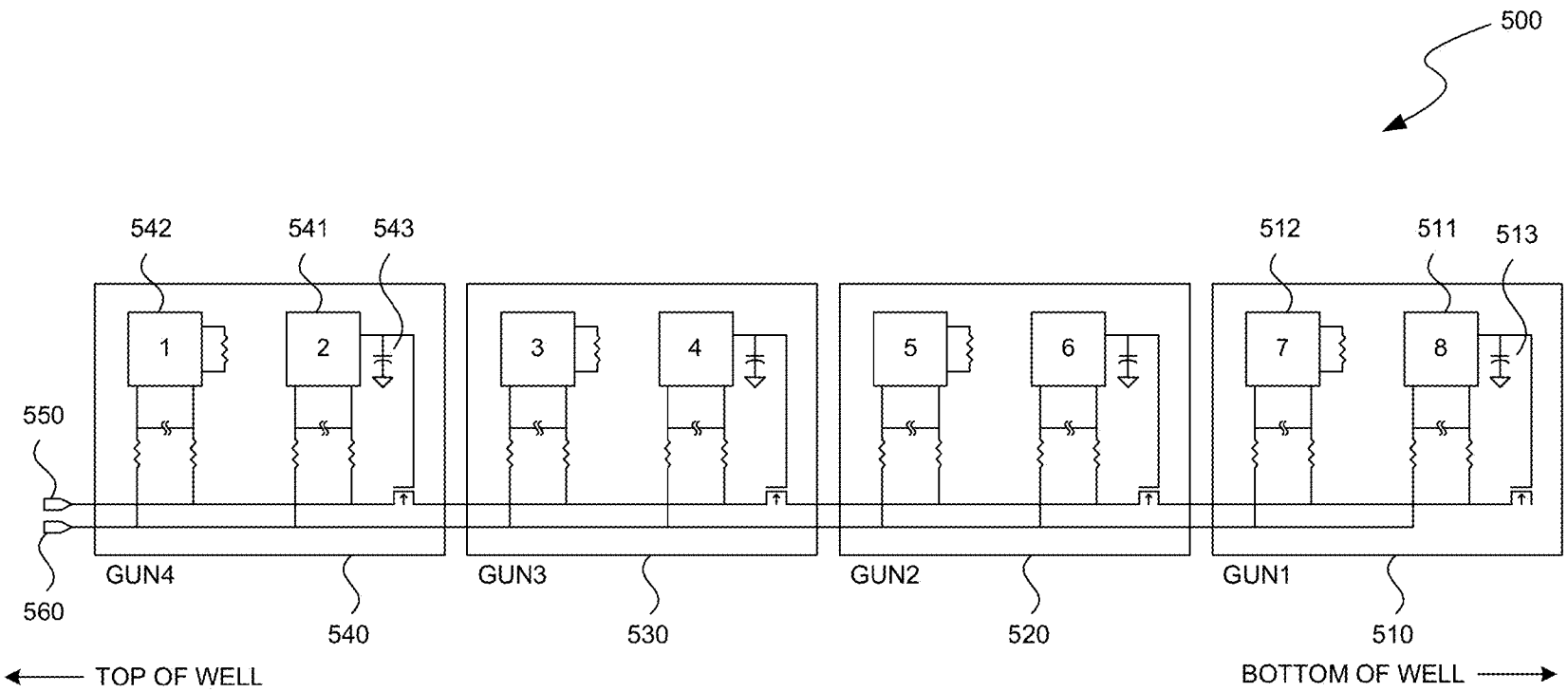
FIG. 5 illustrates plurality of detonator electronics corresponding to a plurality of perf guns in a networked switching system in accordance with an embodiment of the disclosure.

The automated addressing configuration is illustrated in FIG. 5. The plurality of detonator electronics 500 can be seen as electronics corresponding to a plurality of guns, GUN 1-GUN 4 (510, 520, 530, 540), where GUN 1 510 is closest to the bottom of the well, and GUN 4 540 is closest to the top of the well. The electronics for each gun includes two ASICs. For example, for GUN 4 540, Firing ASIC 542 and Communication ASIC 541 are both connected to the high voltage wire 550 and the communication bus 560. ASIC 541 includes ERC 543. When the communication ASIC 541 is "activated," the ERC pin charges the ERC capacitor. Communication ASIC 541 can be used to either open or close the bus 560 and the high voltage wire 550. By charging ERC 543, communication ASIC 541 closes the communications bus 560 and the high voltage wire 550 to the next perf gun assembly in the gun train. In some embodiments, the communication ASIC 541 is only used to close switches connecting the other guns, and it does not ARM or FIRE the perf gun. Firing ASIC 542 is utilized to ARM and FIRE the perf gun. During installation, when a gun assembly is installed in the control system, the communication ASIC of the installed gun assembly is activated, which in turn, allows the next gun assembly in the gun train to be connected based on the logic high state of the ERC pin on the ASIC that was just activated. When the system is first turned on, only one gun assembly is initially detected. Once this gun assembly is activated (by charging the ERC for that communication ASIC), a second gun assembly is detected by the control system. When the second communication ASIC is activated, then a third gun assembly will be detected by the control system, and so on. Eventually the end of the gun train is reached. In this manner, the software at the top of the well in the control panel box 30 that the user uses can "build" the gun train in the correct order by associating each ASIC's unique address with its order in the gun train.

Figure 6:
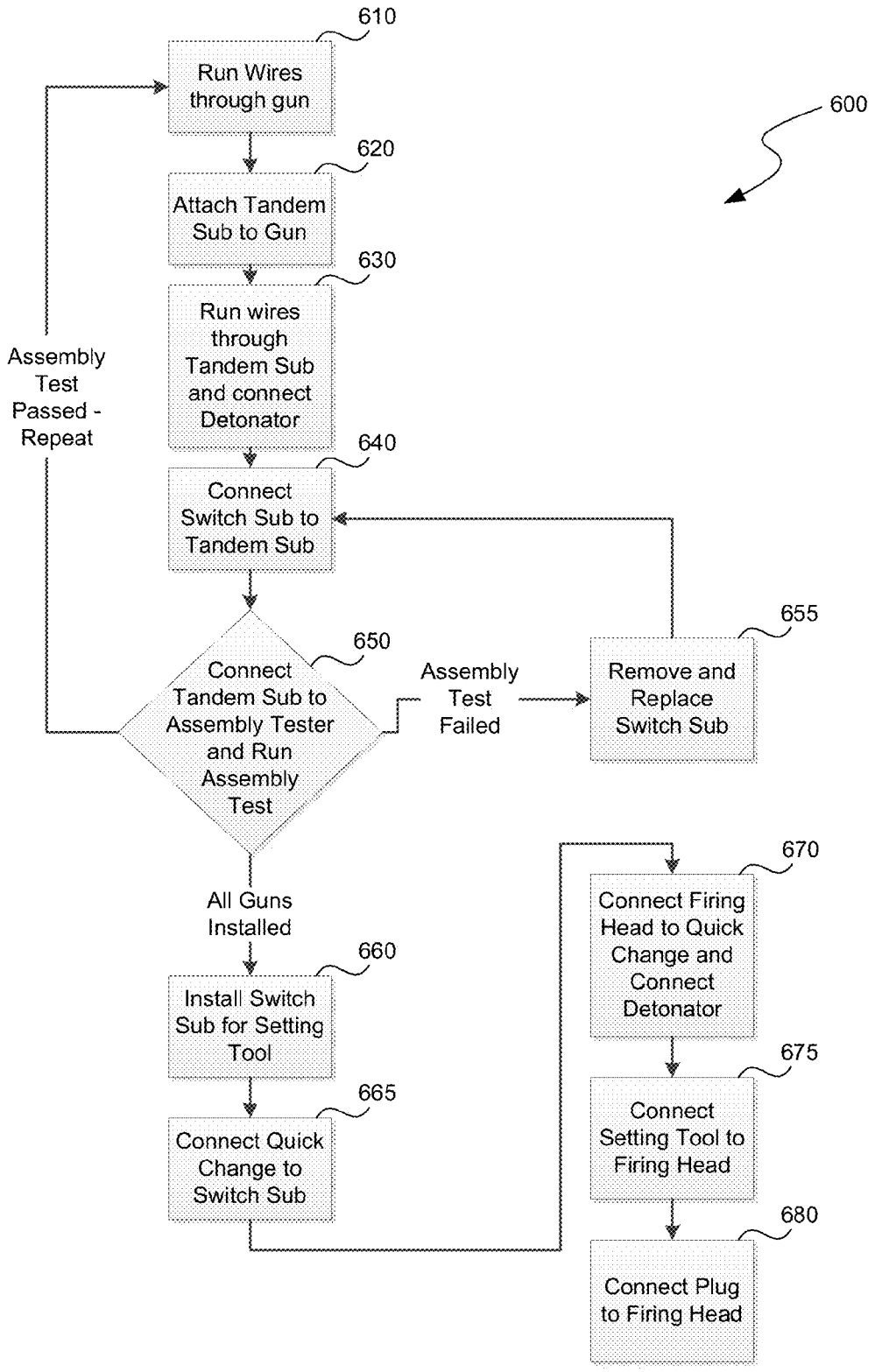
FIG. 6 is a flow diagram for an "in-shop" assembly process for a networked switching system in accordance with an embodiment of the disclosure.

Referring to FIG. 6, flow diagram 600 illustrates the "in-shop" assembly process of the perf gun train. In step 610, an installer runs the wires (e.g., bus 412 and high voltage wire 411—see FIG. 4) through the perf gun 410 and then in step 620, the tandem sub 420 is attached to the perf gun 410. In step 630, the wires are then run through the tandem sub 420 and the detonator (e.g., detonator cord 421—see FIG. 4) is connected. The switch sub 430 is then connected to the tandem sub 420 in step 640. In step 650, the tandem sub 420 is connected to an assembly tester so that an assembly test is run.

If the assembly test has passed, the next perf gun assembly is assembled as discussed above. If not, then in step 655, the switch sub 430 is removed and replaced.

If in step 650, it is determined that all perf gun assemblies have been installed, then in step 660, a setting tool is attached. The user installs a switch sub for the setting tool (the switch sub of the setting tool is different from that of a switch sub for firing a gun), and then a "quick change" assembly is attached to the switch sub of the setting tool in step 665. A quick change assembly connects the top sub to the wire line. In step 670, the detonator for the setting tool is connected. In step 675, the setting tool is connected to the firing head, and lastly in step 680, the plug is connected to the firing head.

Figure 7:
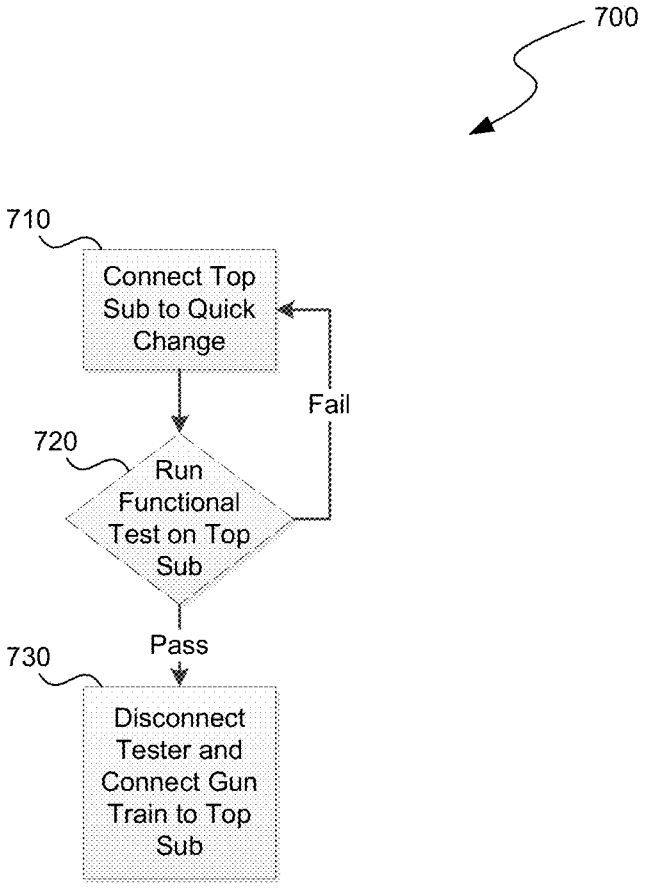
FIG. 7 is a flow diagram for an "in field" assembly process for a networked switching system in accordance with an embodiment of the disclosure.

FIG. 7 illustrates a flow diagram 700 for assembling the perf gun train and the top sub in the field. In the field, a user has an entire gun train, with all the perf gun assemblies (switch subs, tandem subs, and perf guns), setting tool, plug, etc. The whole gun train, which can be a 25-foot long pipe, is connected to the top sub that is in the field. In step 710, the user connects the top sub to the quick change assembly, and then runs a functional test on the top sub to ensure functional operation (see step 720). If the functional test passes, in step 730, the tester is disconnected and the gun train is connected to the top sub.

Figure 8:
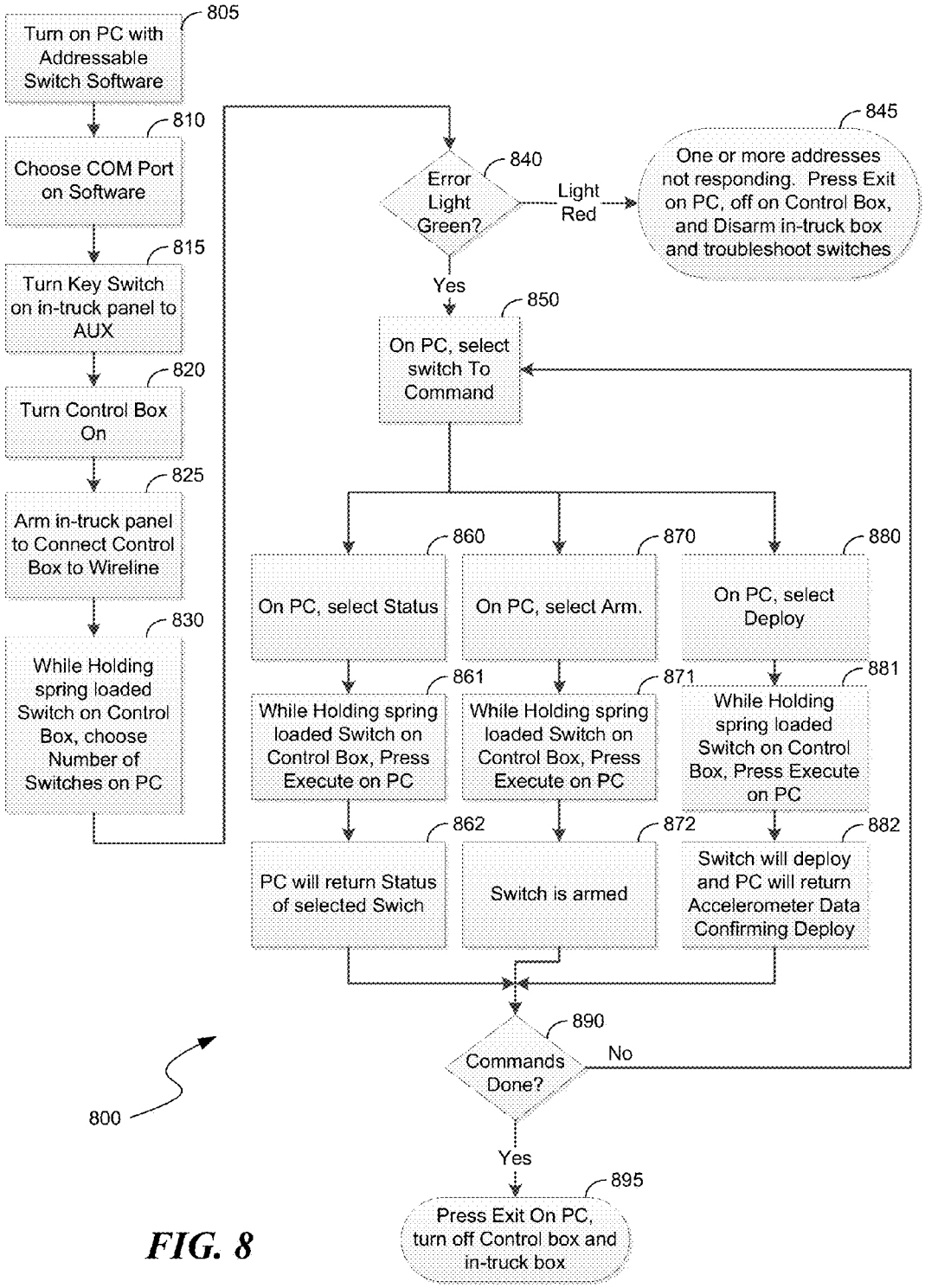
FIG. 8 is a flow diagram of an employment of a networked switching system in accordance with an embodiment of the disclosure.

FIG. 8 provides a flow diagram 800 for employment of the system. The computer system (e.g., control panel 10) is turned on in step 805 with the addressable switch software. A COM port is selected (in step 810) and a key switch on an in-truck panel is turned to auxiliary (in step 815). The control box (e.g., control panel box 30) is turned on (in step 820) and the in-truck panel is armed to connect the control box (e.g., control panel box 30) to the wireline (e.g., wireline 40) (in step 825). The number of switches (corresponding to the number of perf gun assemblies) is then chosen in step 830.

Upon selecting the number of switches, if there is an error, it will be indicted in 840. At that point, a red light indicates (in 845) that one or more addresses are not responding, which requires troubleshooting. In addition, the addressable switch software is exited on the PC (e.g., control panel 10), the control box (e.g., control panel box 30) is turned off, and the in-truck box is disarmed.

If no errors are presented, then a switch to be command is selected via the PC (e.g., control panel 10) (see step 850). If STATUS is selected (see FIG. 2) at step 860, and the command is executed in 861, the PC provides a status indication of the selected switch in step 862. If ARMED is selected (see FIG. 2) at step 870, and the command is executed in 871, the selected switch is armed (step 872). In some embodiments, the PC (e.g., control panel 10) can also DISARM the selected switch. If DEPLOYED (FIRED) is selected (see FIG. 2) at step 880, and the command is executed in 881, the selected switch will deploy (fire) in step 862. In some embodiments, where accelerometers are installed in the switch subs 420, the PC will receive the accelerometer data confirming that the perf gun explosives have detonated or indicating that the selected perf gun a failed to fire. For example, in some embodiments the top sub includes an accelerometer that transmits the accelerometer data to the PC (e.g., control panel 10). In some embodiments, individual perf gun assemblies can include accelerometers in addition to or instead of the accelerometer in the top gun.

After a command is executed, the system determines whether another command is being indicated in step 890. If all commands are completed, the system is disconnected in step 895.

Figure 10:
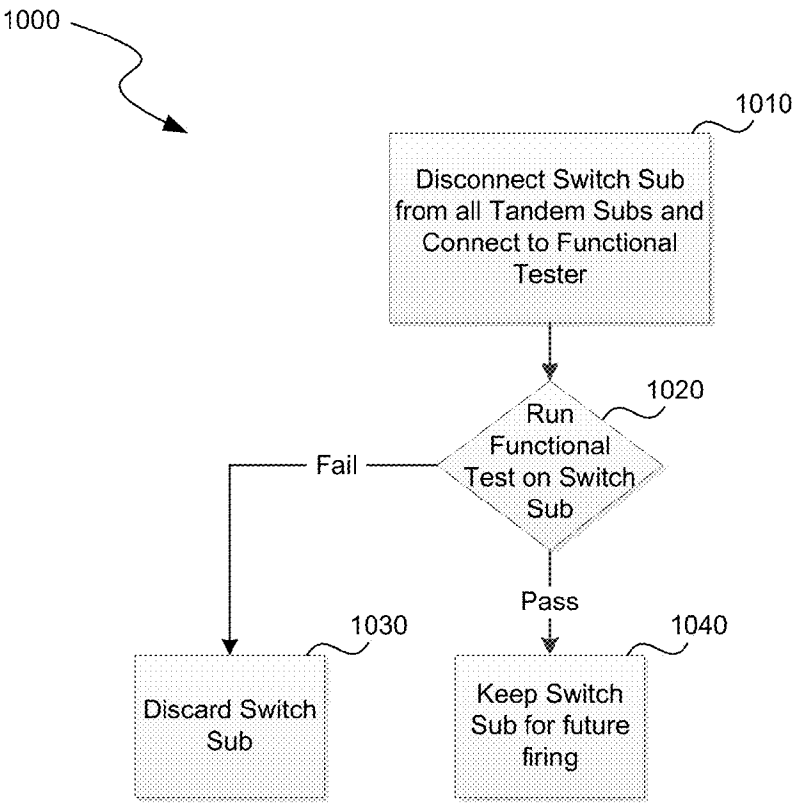
FIG. 10 is a flow diagram of a process for testing switch subs of a networked switching system for possible reuse.
Figure 9:
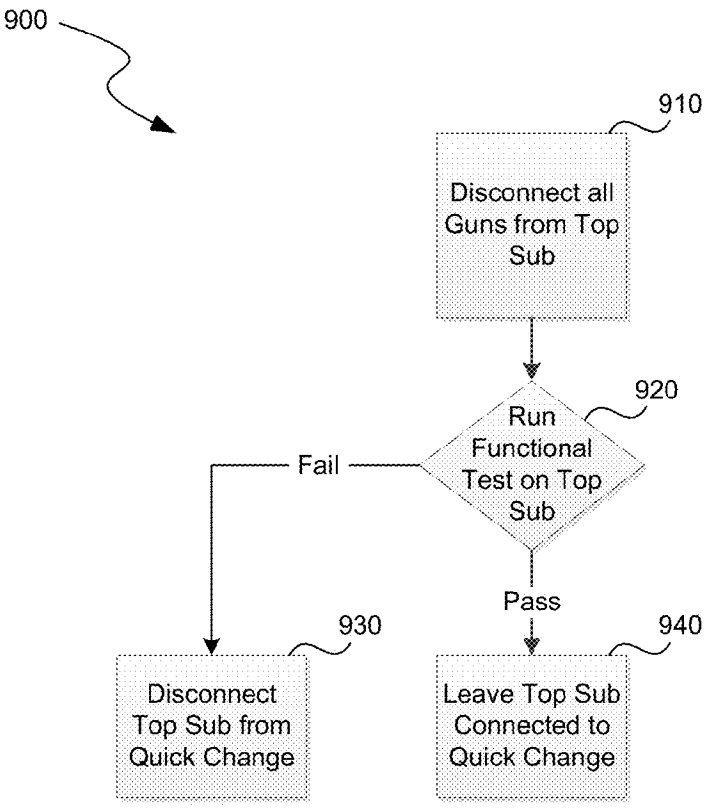
FIG. 9 is a flow diagram of a process for testing the top sub of a networked switching system for possible reuse.

Finally, FIGS. 9 and 10 are processes for recovery 900 and redress 1000. After a gun train has been employed, it is pulled out of the hole. Via FIGS. 9 and 10, the electronics are then tested, both the top sub and the switch subs to ensure that they remain functional. If they are still functioning, the user can put them back in the queue and build them up on the next gun train. If they are not functional, they can put them aside. It is anticipated that the electronics are sufficiently insulated from the environment so that they can be re-used multiple times.

Accordingly, in FIG. 9, all guns are disconnected from the top sub in step 910, a functional test is run in step 920, and if it passes, the top sub will be reused (via step 940). Otherwise, it is disconnected in step 930. In FIG. 10, the switch subs are disconnected from the tandem subs in step 1010, the functional test is run in step 1020, and the switch subs are kept if functional, via step 1040, or otherwise discarded via step 1030.

It will be appreciated to those skilled in the art that the preceding examples and embodiments are exemplary and not limiting to the scope of the present invention. It is intended that all permutations, enhancements, equivalents, combinations, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

We claim:

1. An addressable switch system, comprising:

a plurality of perforating gun assemblies arranged in a gun train and lowered into a wellbore, each of the plurality of perforating gun assemblies comprising, a switch sub comprising a network communications module with a unique network address for communications over a network bus, and a perforating gun comprising explosives;

a control panel for at least one of monitoring and controlling the plurality of perforating gun assemblies; and a top sub comprising a top sub controller that is lowered into the wellbore, the top sub controller having a first communications module to communicate with the control panel via a wireline and a second communications module to communicate with the plurality of perforating gun assemblies via the network bus, wherein the control panel comprises an interface to select one perforating gun assembly from the plurality of perforating gun assemblies based on the unique network address of the switch sub corresponding to the selected perforating gun assembly, and to provide a command signal that at least one of arms and fires the perforating gun corresponding to selected perforating gun assembly, and wherein the control panel is configured to automatically detect an order of the perforating gun assemblies in the gun train based on polling each of the switch subs of the plurality of perforating gun assemblies using the respective unique network addresses.

2. The addressable switch system of claim 1, wherein the switch sub corresponding to the selected perforating gun assembly comprises switch electronics that performs the at least one of arming and firing the perforating gun based on the command signal from the control panel.

3. The addressable switch system of claim 1, wherein the perforating gun assemblies comprise a tandem sub that includes a detonator wire to detonate the explosives in the perforating gun, and the detonator wire is connected to switch electronics in the switch sub that control a firing signal to the detonator wire.

4. The addressable switch system of claim 3, wherein the switch sub, the tandem sub, and the perforating gun of each perforating gun assembly are assembled using rotary connector assemblies.

5. The addressable switch system of claim 1, wherein the interface is a graphical user interface (GUI).

6. The addressable switch system of claim 1, wherein at least one of the top sub and the switch sub comprises sensors to monitor conditions in the perforating gun assemblies or the wellbore.

7. The addressable switch system of claim 6, wherein the sensors include at least one of a temperature sensor, a pressure sensor, and an accelerometer.

8. The addressable switch system of claim 7, wherein the sensors include the accelerometer, and wherein data from the accelerometer is transmitted to the control panel to determine whether a perforating gun exploded.

9. The addressable switch system of claim 1, wherein the switch sub comprises glass-to-metal seals that protect that protect electronics within the switch sub from conditions outside the switch sub, and wherein the switch sub comprises a thermal management material to increase a thermal lag in the switch sub.

10. The addressable switch system of claim 1, wherein the switch sub comprises sensors and the control panel is configured to display information detected by the sensors.

11. A method for operating an addressable switch system, comprising:

providing a plurality of perforating gun assemblies, with each of the plurality of perforating gun assemblies comprising a switch sub and a perforating gun;

providing a top sub comprising a top sub controller;

providing a unique network address for communications over a network bus to each of the switch subs in the plurality of perforating gun assemblies;

assembling the plurality of perforating gun assemblies as a gun train that includes the top sub controller, and automatically detecting an order of the perforating gun assemblies in the gun train based on polling each of the switch subs of the plurality of perforating gun assemblies using the respective unique network addresses;

installing explosives in each of the perforating guns of the plurality of perforating gun assemblies;

monitoring and controlling the plurality of perforating gun assemblies using a control panel;

communicating between the control panel and the top sub controller via a wireline;

communicating between the top sub controller and the plurality of perforating gun assemblies via the network bus;

selecting one perforating gun assembly from the plurality of perforating gun assemblies based on the unique network address of the switch sub corresponding to the selected perforating gun assembly; and providing a command signal that at least one of arms and fires the perforating gun corresponding to selected perforating gun assembly.

12. The method for operating an addressable switch system of claim 11, wherein the switch sub corresponding to the selected perforating gun assembly comprises switch electronics that performs the at least one of arming and firing the perforating gun based on the command signal from the control panel.

13. The method for operating an addressable switch system of claim 11, further comprising:

providing a detonator wire to detonate the explosives in the perforating gun, wherein the detonator wire is connected to switch electronics in the switch sub that control a firing signal to the detonator wire.

14. The method for operating an addressable switch system of claim 11, further comprising:

providing a graphical user interface (GUI) in the control panel.

15. The method for operating an addressable switch system of claim 11, further comprising:

monitoring conditions in the perforating gun assemblies or the wellbore using sensors in at least one of the top sub and the switch sub.

16. The method for operating an addressable switch system of claim 15, wherein the sensors include at least one of a temperature sensor, a pressure sensor, and an accelerometer.

17. The method for operating an addressable switch system of claim 16, wherein the sensors include the accelerometer, and the method further comprises, transmitting data from the accelerometer to the control panel; and determining whether a perforating gun exploded.

18. The method for operating an addressable switch system of claim 11, further comprising:

providing a tandem sub; and assembling the switch sub, the tandem sub, and the perforating gun of each perforating gun assembly using rotary connector assemblies.

19. The method for operating an addressable switch system of claim 11, further comprising:

protecting electronics with the switch sub from conditions outside the switch sub by using glass-to-metal seals that protect that protect electronics within the switch sub, and by using thermal management material to increase a thermal lag in the switch sub.

20. The method for operating an addressable switch system of claim 11, further comprising:

displaying information detected by sensors in the switch sub of one or more perforating gun assemblies.

* * * * *